US007976322B2

(12) United States Patent
Matsumura et al.

(10) Patent No.: US 7,976,322 B2
(45) Date of Patent: Jul. 12, 2011

(54) LEVER FITTING TYPE CONNECTOR

(75) Inventors: Kaoru Matsumura, Makinohara (JP); Akihiro Tsuruta, Fujieda (JP); Koichi Sugiyama, Toyota (JP)

(73) Assignee: Yazaki Corporation, Tokyo (JP)

( * ) Notice: Subject to any disclaimer, the term of this patent is extended or adjusted under 35 U.S.C. 154(b) by 81 days.

(21) Appl. No.: 12/360,893

(22) Filed: Jan. 28, 2009

(65) Prior Publication Data

US 2009/0203240 A1 Aug. 13, 2009

(30) Foreign Application Priority Data

Feb. 8, 2008 (JP) ..... 2008-028603

(51) Int. Cl.
*H01R 13/62* (2006.01)

(52) U.S. Cl. ..... 439/153

(58) Field of Classification Search ..... 439/153, 439/157, 372
See application file for complete search history.

(56) References Cited

U.S. PATENT DOCUMENTS

| | | | | |
|---|---|---|---|---|
| 6,176,713 | B1 * | 1/2001 | Okabe | 439/157 |
| 6,183,277 | B1 * | 2/2001 | Okabe et al. | 439/157 |
| 6,213,794 | B1 | 4/2001 | Okabe et al. | |
| 7,513,783 | B2 * | 4/2009 | Okuda et al. | 439/157 |

FOREIGN PATENT DOCUMENTS

| | | | |
|---|---|---|---|
| DE | 19936871 | A1 | 3/2000 |
| JP | 11-031551 | A | 2/1999 |
| JP | 2000-091026 | A | 3/2000 |

OTHER PUBLICATIONS

Office Action issued Nov. 9, 2010 in counterpart German Application No. 102009008109.7.

* cited by examiner

*Primary Examiner* — T C Patel
*Assistant Examiner* — Travis Chambers
(74) *Attorney, Agent, or Firm* — Sughrue Mion, PLLC

(57) ABSTRACT

A lever fitting type connector includes a male connector, a lever which is rotatably attached to the male connector, and a female connector which has a fitting space into which the male connector is inserted. The lever has a fulcrum protrusion provided on one end portion of the lever. An inner wall forming the fitting space of the female connector has a guiding groove portion and a receiving groove portion for receiving the fulcrum protrusion. The guiding groove portion extends in a fitting direction of the male connector with respect to the female connector from an upper end portion of the inner wall toward the inside of the fitting space. The receiving groove portion which is communicated with the guiding groove portion and extends in a direction intersecting the fitting direction from one end of the guiding groove portion which is away from the upper portion of the inner wall. The fulcrum protrusion is positioned to the inside of the receiving groove portion at a time when an unrotatable state of the lever is released.

2 Claims, 16 Drawing Sheets

LEVER FITTING TYPE CONNECTOR

BACKGROUND

The present invention relates to a lever fitting type connector capable of fitting a male connector to a female connector by rotating a lever mounted to the male connector.

Recently, a lever fitting type connector for reducing a fitting operation force by means of a lever is employed upon fitting both male and female connectors having terminals of multi poles to each other (for example, see Patent Document 1).

This kind of lever fitting type connector is shown in FIG. 18. A lever fitting type connector 100 shown in FIG. 18 includes a male connector 121, a lever 122 of which a center portion is rotatably mounted to a boss portion 127 of a side surface 125 of a male connector 121, and a female connector 123 having a fitting space into which the male connector 121 is inserted.

The lever 122 includes a pair of side plates 128 overlapping with the both side surfaces 125 of the male connector 121 and an operation portion 129 connecting the other end portions of the pair of side plates 128 to each other. Additionally, each side plate 128 is provided with a hole for allowing the boss portion 127 to be positioned to the center portion; a fulcrum protrusion 130 provided on the side of one end portion thereof so as to serve as a fulcrum upon rotating the lever; and a temporary retaining portion 138 provided at the lower end portion on the side of the other end portion thereof. The temporary retaining portion 138 is used to prevent the lever 122 from rotating to the female connector 123 by being positioned to a position more away from the female connector 123 than a temporary fixing convex portion 137 protruding from the side surface of the male connector 121 at an initial fitting step.

The female connector 123 includes a female-type connector housing 132 having a fitting space. An inner wall forming the fitting space of the connector housing 132 is provided with a fulcrum protrusion guiding groove 134 extending from the upper end portion of the inner wall toward the inside of the fitting space; a fulcrum protrusion receiving groove 135 connected to the fulcrum protrusion guiding groove 134 and extending in a direction intersecting the fulcrum protrusion guiding groove 134; and a plate-shape release plate portion 139.

The fulcrum protrusion receiving groove 135 is a groove for positioning the fulcrum protrusion 130 thereto upon rotating the lever 122 so as to allow the fulcrum protrusion 130 to serve as a fulcrum of the lever 122.

As the male connector 121 moves close to the female connector 123, the release plate portion 139 advances to the inside of the temporary retaining portion 138 so as to allow the temporary retaining portion 138 to be bent outward, thereby allowing the temporary retaining portion 138 to pass over to the temporary fixing convex portion 137 on the side of the female connector 123.

In the lever fitting type connector 100, the fulcrum protrusion 130 is positioned to the inside of the fulcrum protrusion receiving groove 135 after passing through the fulcrum protrusion guiding groove 134. When the operation portion 129 is pressed toward the female connector 123 to thereby rotate the lever 122 in this state, the fulcrum protrusion 130 serves as a fulcrum, the hole for positioning the boss portion 127 serves as an action point, and then the male connector 121 is pressed into the fitting space, thereby fitting the male connector 121 to the female connector 123. Additionally, when the fulcrum protrusion 130 is positioned to the inside of the fulcrum protrusion receiving groove 135, the release plate portion 139 advances to the inside of the temporary retaining portion 138 so as to allow the temporary retaining portion 138 to pass over to the temporary fixing convex portion 137 on the side of the female connector 123, thereby releasing the unrotatable state of the lever 122.

[Patent Document 1] JP-A-2000-91026

The above-described lever fitting type connector 100 has the following problems to be solved. That is, in the related lever fitting type connector 100, a problem arises in that an idle rotation of the lever 122 occurs in a case where the unrotatable state of the lever 122 is released before the fulcrum protrusion 130 is positioned to the inside of the fulcrum protrusion receiving groove 135.

The inventors of the invention have investigated the reason and have found out that a timing at which the unrotatable state of the lever 122 is released becomes different in accordance with a method of applying a force to the operation portion 129 since an angle of a taper portion 139*a* formed on the upper end portion of the release plate portion 139 is gentle, and hence a lever operation stroke becomes long when the temporary retaining portion 138 passes over the taper portion 139*a*.

Additionally, a locking force (a temporary lock holding force) of the temporary retaining portion 138 applied to the temporary fixing convex portion 137 in order to maintain the unrotatable state of the lever 122 is determined by an amount in which the temporary retaining portion 138 overlaps with the taper portion 139*a*. The locking force becomes zero at a time point when the temporary retaining portion 138 completely passes over the taper portion 139*a*. That is, the unrotatable state of the lever 122 is released.

SUMMARY

Therefore, an object of the invention is to provide a lever fitting type connector capable of reliably fitting connectors to each other by preventing an idle rotation of a lever.

In order to achieve the above-described object, according to the invention, there is provided a lever fitting type connector, comprising:

a male connector;

a lever which is rotatably attached to the male connector; and a female connector which has a fitting space into which the male connector is inserted, wherein the lever has a fulcrum protrusion provided on one end portion of the lever;

wherein an inner wall forming the fitting space of the female connector has a guiding groove portion and a receiving groove portion for receiving the fulcrum protrusion;

wherein the guiding groove portion extends in a fitting direction of the male connector with respect to the female connector from an upper end portion of the inner wall toward the inside of the fitting space;

wherein the receiving groove portion which is communicated with the guiding groove portion and extends in a direction intersecting the fitting direction from one end of the guiding groove portion which is away from the upper portion of the inner wall;

wherein the lever has a temporary retaining portion for preventing the lever from rotating to the female connector at an initial fitting process;

wherein the inner wall has a release portion for releasing an unrotatable state of the lever by means of the temporary retaining portion;

wherein when the lever is pressed toward the female connector so as to rotate the lever in a state where the fulcrum protrusion of the lever is positioned to the inside of the receiving groove portion, the fulcrum protrusion serves as a fulcrum, a center portion of the lever serves as an action point, and the male connector is pressed to the inside of the fitting space in the fitting direction; and wherein the fulcrum protrusion is positioned to the inside of the receiving groove portion at a time when the unrotatable state of the lever is released.

Preferably, the temporary retaining portion is abutted against a temporary fixing convex portion of the male connector for preventing the lever from rotating to the female connector. The release portion releases the unrotatable state of the lever by advancing to the inside of the temporary retaining portion to bent the temporary retaining portion outward so that the temporary retaining portion passes over to the temporary fixing convex portion on the side of the female connector as the male connector moves close to the female connector. A taper portion, whose thickness is gradually increased toward the inside of the fitting space in the fitting direction, is provided on an upper end portion of the release portion. An angle of the taper portion is in a range of 60° to $90-(\tan^{-1}\times\text{friction coefficient } \mu)°$.

Preferably, an edge wall forming the receiving groove portion has a first taper wall and a second taper wall for guiding the fulcrum protrusion to the first taper wall.

Here, it is preferable that, the first taper wall is inclined so as to decrease a width of the receiving groove portion in a direction away from the guiding groove portion. The second taper wall is inclined so as to increase a width of the receiving groove portion in a direction from the first taper wall to the guiding groove portion.

According to the above configuration, since the fulcrum protrusion is reliably positioned to the inside of the receiving groove portion at a time when the unrotatable state of the lever is released, it is possible to provide the lever fitting type connector capable of fitting the connectors to each other by preventing an idle rotation of the lever.

According to the above configuration, since the upper end portion of the release portion has the taper portion whose thickness is gradually increased toward the inside of the fitting space in the fitting direction, an angle of the taper portion is in a range of 60° to $90-(\tan^{-1}\times\text{friction coefficient } \mu)°$, and then the angle of the taper portion is larger than that of the known taper portion, it is possible to reduce a lever operation stroke when the temporary retaining portion passes over the taper portion more than the related lever fitting type connector. For this reason, even when a force is applied to an operation portion in a different manner, a deviation hardly occurs at timing when the unrotatable state of the lever is released. Accordingly, it is possible to reliably position the fulcrum protrusion to the receiving groove portion at a time when the unrotatable state of the lever is released.

According to the above configuration, since the edge wall forming the receiving groove portion has the first taper wall and the second taper wall for guiding the fulcrum protrusion to the first taper wall, even when the unrotatable state of the lever is released at early timing, the second taper wall is capable of selectively guiding the fulcrum protrusion to the first taper wall on the inside of the receiving groove portion. Accordingly, it is possible to reliably position the fulcrum protrusion to the receiving groove portion at a time when the unrotatable state of the lever is released.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

Hereinafter, a lever fitting type connector 10 according to an embodiment of the invention will be described with reference to FIGS. 1 to 17.

Figure 1:
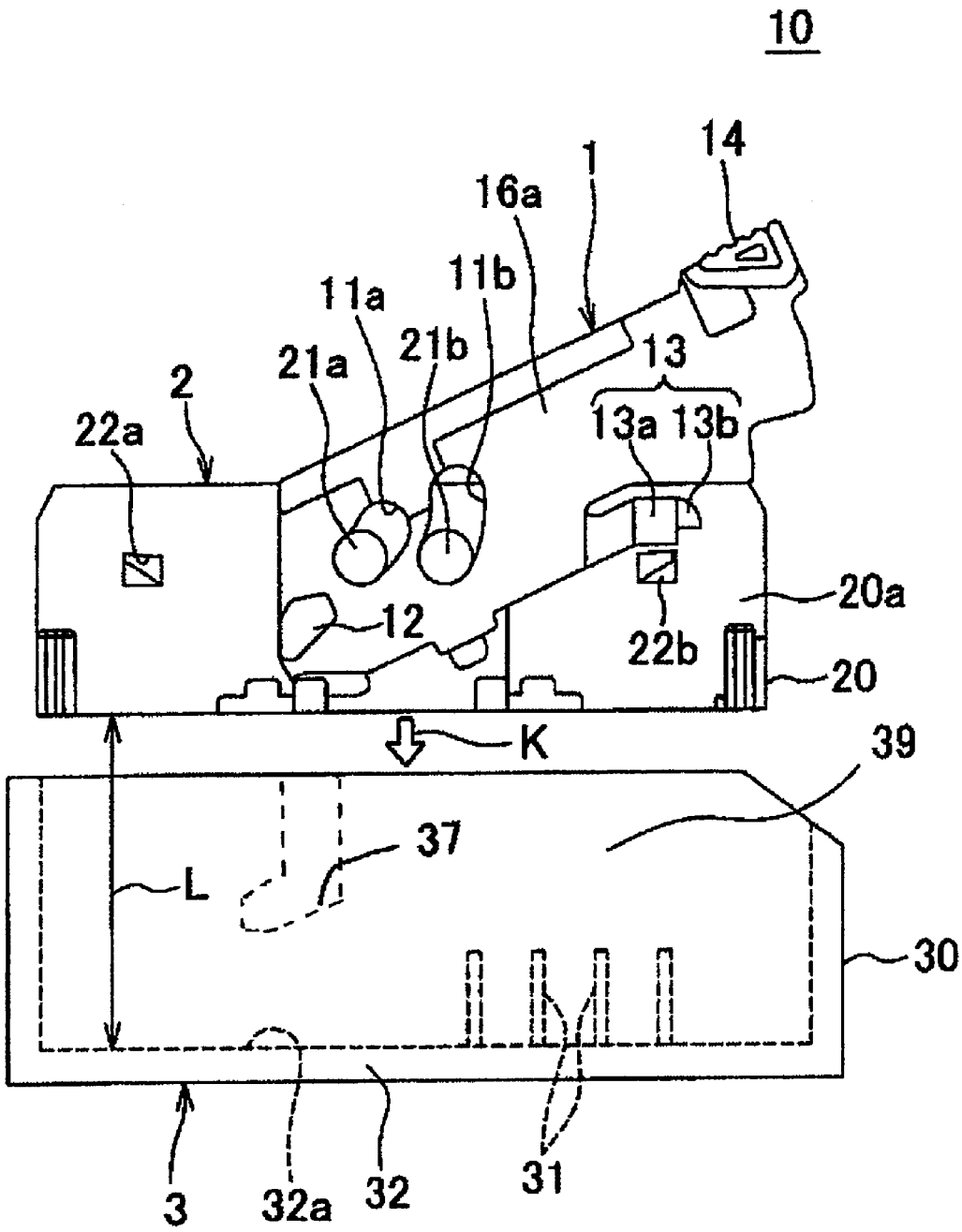
FIG. 1 is a top view showing a lever fitting type connector according to an embodiment of the invention.

The lever fitting type connector 10 shown in FIG. 1 is a lever fitting type connector 10 which includes a male-type connector (hereinafter, referred to as a male connector) 2, a lever 1 rotatably provided in a connector housing 20 of the male connector 2, and a female-type connector (hereinafter, referred to as a female connector) 3 having a connector housing 30 with a fitting space 39 to which the male connector 2 is inserted, where when the lever 1 is rotated, the male connector 2 is pressed toward the inside of the fitting space 39 in a fitting direction K so as to be fitted to the female connector 3.

Figure 2:
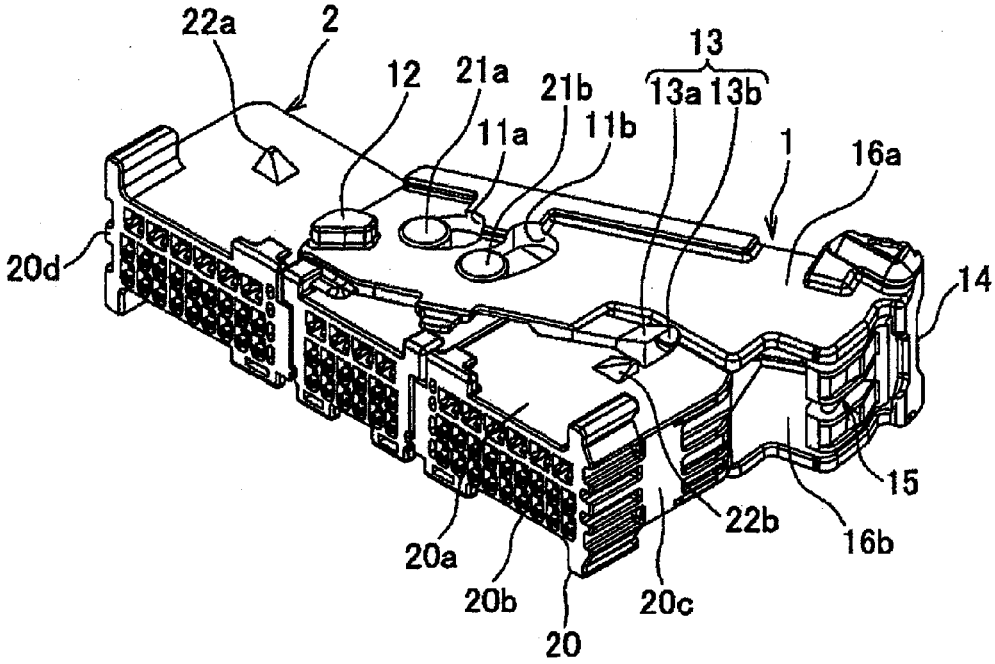
FIG. 2 is a perspective view showing a lever and a male connector of the lever fitting type connector shown in FIG. 1.

As shown in FIGS. 1 and 2, the male connector 2 includes the connector housing 20 formed of insulation synthetic resin to have a rectangular shape and a female-type terminal 29 (see FIG. 12B) received in the connector housing 20. The connector housing 20 includes side surfaces 20*a* and 20*b* opposed to each other and connection surfaces 20*c* and 20*d* connecting both end portions of the side surfaces 20*a* and 20*b* to each other. Additionally, cylindrical boss portions 21*a* and 21*b* having a gap therebetween are provided in the center in a longitudinal direction of the side surfaces 20*a* and 20*b*. The longitudinal direction corresponds to a direction intersecting the fitting direction K shown in FIG. 1. Trapezoid-shape temporary fixing convex portions 22*a* and 22*b* are respectively formed in a protruding manner in the surfaces of the side surfaces 20*a* and 20*b* in both end portions in a longitudinal direction of the side surfaces 20*a* and 20*b*.

Figure 3:
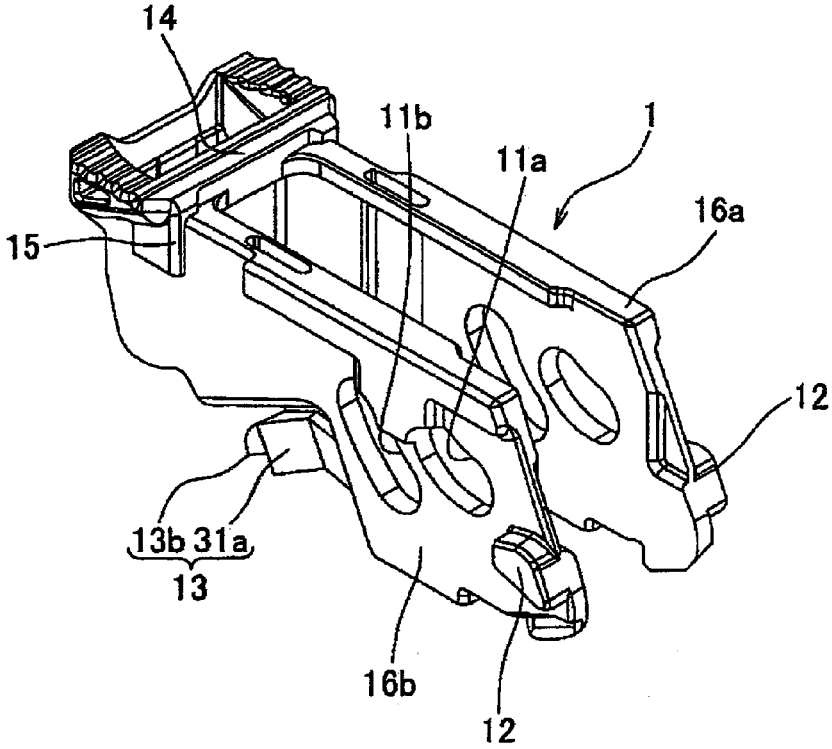
FIG. 3 is a perspective view showing the lever of the lever fitting type connector shown in FIG. 1.

As shown in FIGS. 1 to 3, the lever 1 is formed of insulation synthetic resin, and includes a pair of side plates 16*a* and 16*b* which are disposed in parallel to each other and of which one end portions are away from each other with a gap therebetween and an operation portion 14 which connects the other end portions of the pair of side plates 16*a* and 16*b* to each other. The operation portion 14 is a position where a load acts on upon rotating the lever 1, that is, a force point of the lever 1. Additionally, the operation portion 14 is provided with a lock arm 15 which is locked to the connector housing 30 on the side of the female connector 3 in a state where the male connector 2 is fitted to the female connector 3. By locking the lock arm 15 to the connector housing 30, it is possible to prevent the male connector 2 from moving in a direction away from the female connector 3 when a undesired external force acts on the lever 1.

The pair of side plates 16*a* and 16*b* has a fulcrum protrusion 12 formed on one end portion thereof. When the fulcrum protrusion 12 is positioned at a fulcrum protrusion receiving groove 37 provided in the connector housing 30 on the side of the female connector 3, the fulcrum protrusion 12 engages with the connector housing 30 so as to serve as a fulcrum of the lever 1. Additionally, a pair of boss portion receiving holes 11*a* and 11*b* is provided at a position closer to the other end than the fulcrum protrusion 12 so as to position the boss portions 21*a* and 21*b*, respectively. The boss portion receiving holes 11*a* and 11*b* serve as an action point of the lever 1.

Further, a temporary retaining portion 13 is provided at the lower end portions on the side of the other end portions of the pair of side plates 16*a* and 16*b*. The temporary retaining portion 13 is positioned at a position more away from the female connector 3 than one of the temporary fixing convex portions 22*a* and 22*b* at an initial fitting step between the connectors 2 and 3, thereby preventing the lever 1 from rotating to the female connector 3. The temporary retaining portion 13 includes a contact convex portion 13*a* having an end surface brought into contact with the temporary fixing convex portions 22*a* and 22*b* and a flexible piece 13*b* connected to the contact convex portion 13*a* and extending toward the other end portions of the side plates 16*a* and 16*b*. The flexible piece 13*b* is formed to have a thickness smaller than the contact convex portion 13*a* so as to be easily bent. Additionally, the flexible piece 13*b* extends outward in a direction in which the pair of side plates 16*a* and 16*b* are opposed to each other.

Figure 4:
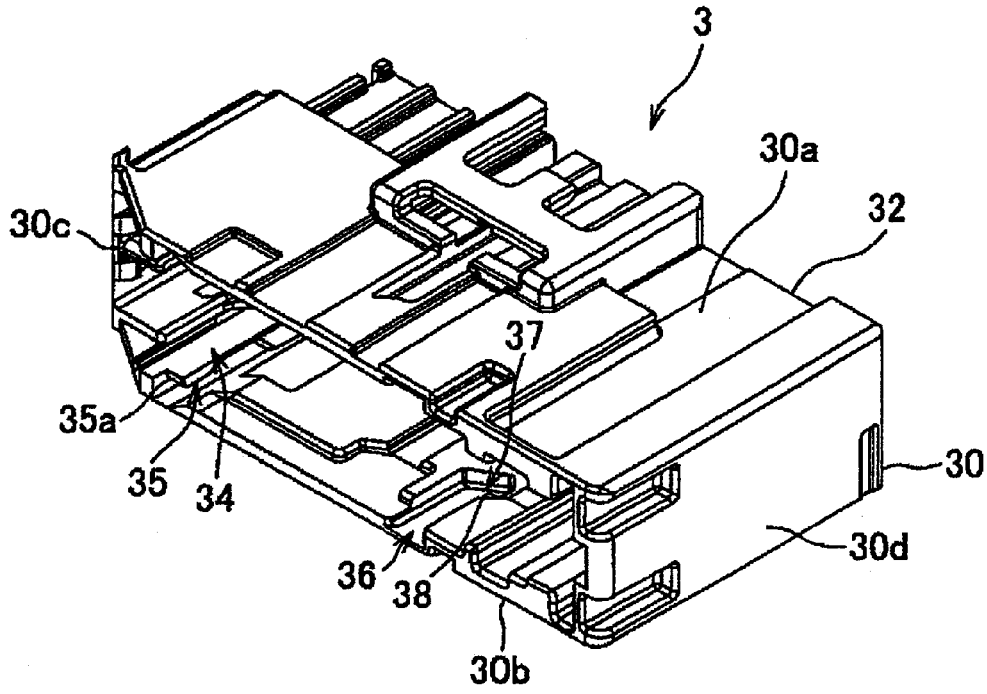
FIG. 4 is a perspective view showing a female connector of the lever fitting type connector shown in FIG. 1.

As shown in FIGS. 1 and 4, the female connector 3 is formed of insulation synthetic resin, and includes the female-type connector housing 30 having the fitting space 39 and a male-type terminal 31 received in the connector housing 30. The male-type terminal 31 is fitted to a female-type terminal 29 of the male connector 2.

The connector housing 30 includes side surfaces 30*a* and 30*b* opposed to each other; connection surfaces 30*c* and 30*d* connecting both end portions of the side surfaces 30*a* and 30*b*; and a bottom surface 32 supporting the terminal 31 provided on the opposite side of an opening of the fitting space 39. Additionally, the fitting space 39 is formed by the side surfaces 30*a* and 30*b*; the connection surfaces 30*c* and 30*d*; and the bottom surface 32. The inner surfaces (the inner walls) of the side surfaces 30*a* and 30*b* are provided with a fulcrum protrusion guiding groove 36 extending from the upper end portion (corresponding to the end portion away from the bottom surface 32) of each inner surface toward the inside of the fitting space 39 in the fitting direction K; a fulcrum protrusion receiving groove 37 connected to the end portion of the fulcrum protrusion guiding groove 36 away from the upper end portion thereof and extending in a direction intersecting the fulcrum protrusion guiding groove 36; and a plate-shape release plate portion 35.

The fulcrum protrusion receiving groove 37 is a groove which positions the fulcrum protrusion 12 thereto upon rotating the lever 1 so as to allow the fulcrum protrusion 12 to serve as a fulcrum of the lever 1. As shown in FIGS. 12 to 15, the fulcrum protrusion receiving groove 37 is formed by an edge wall 38 coming into contact with the outer edge portion of the fulcrum protrusion 12. The edge wall 38 is provided with a first taper wall 38*b* and a second taper wall 38*a* guiding the fulcrum protrusion 12 to the first taper wall 38*b*. The first taper wall 38*b* is inclined so as to decrease the width of the fulcrum protrusion receiving groove 37 in a direction away from the fulcrum protrusion guiding groove 36. The second taper wall 38*a* is inclined so as to increase the width of the fulcrum protrusion receiving groove 37 in a direction from the first taper wall 38*b* to the fulcrum protrusion guiding groove 36. The fulcrum protrusion guiding groove 36 is a groove through which the fulcrum protrusion 12 passes upon positioning the fulcrum to the fulcrum protrusion receiving groove 37.

Since the second taper wall 38*a* is provided, in the invention, even when the unrotatable state of the lever 1 is released at early timing, the second taper wall 38*a* is capable of selectively guiding the fulcrum protrusion 12 to the first taper wall 38*b*, thereby reliably positioning the fulcrum protrusion 12 to the fulcrum protrusion receiving groove 37 at a time point when the unrotatable state of the lever 1 is released.

Figure 5:
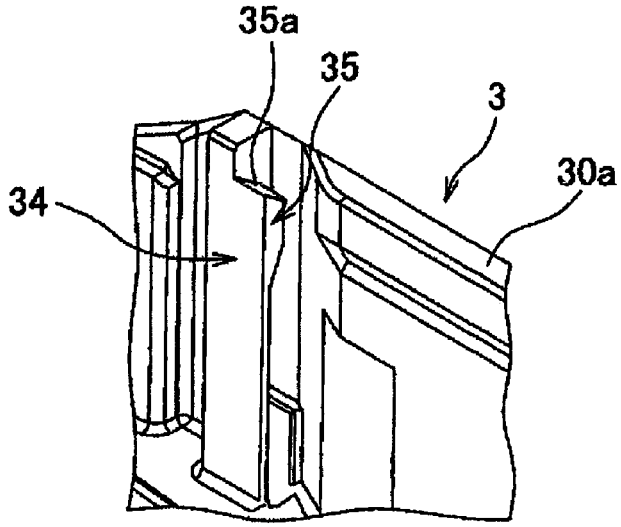
FIG. 5 is a perspective view showing the inside of a housing of the female connector shown in FIG. 4.

As the male connector 2 moves close to the female connector 3, the release plate portion 35 advances to the inside of the flexible piece 13*b* of the temporary retaining portion 13 so as to allow the flexible piece 13*b* to be bent outward in a direction in which the pair of side plates 16*a* and 16*b* is opposed to each other, thereby allowing the contact convex portion 13*a* to pass over to the temporary fixing convex portions 22*a* and 22*b* on the side of the female connector 3. As shown in FIG. 4, the release plate portion 35 is integrally formed with each of opposed walls 34 provided so as to be opposed to the inner surfaces of the side surfaces 30*a* and 30*b*. Additionally, as shown in FIG. 5, the upper end portion of the release plate portion 35 is provided with a taper portion 35*a* of which a thickness gradually increases toward the inside of the fitting space 39 in the fitting direction K.

Figure 18:
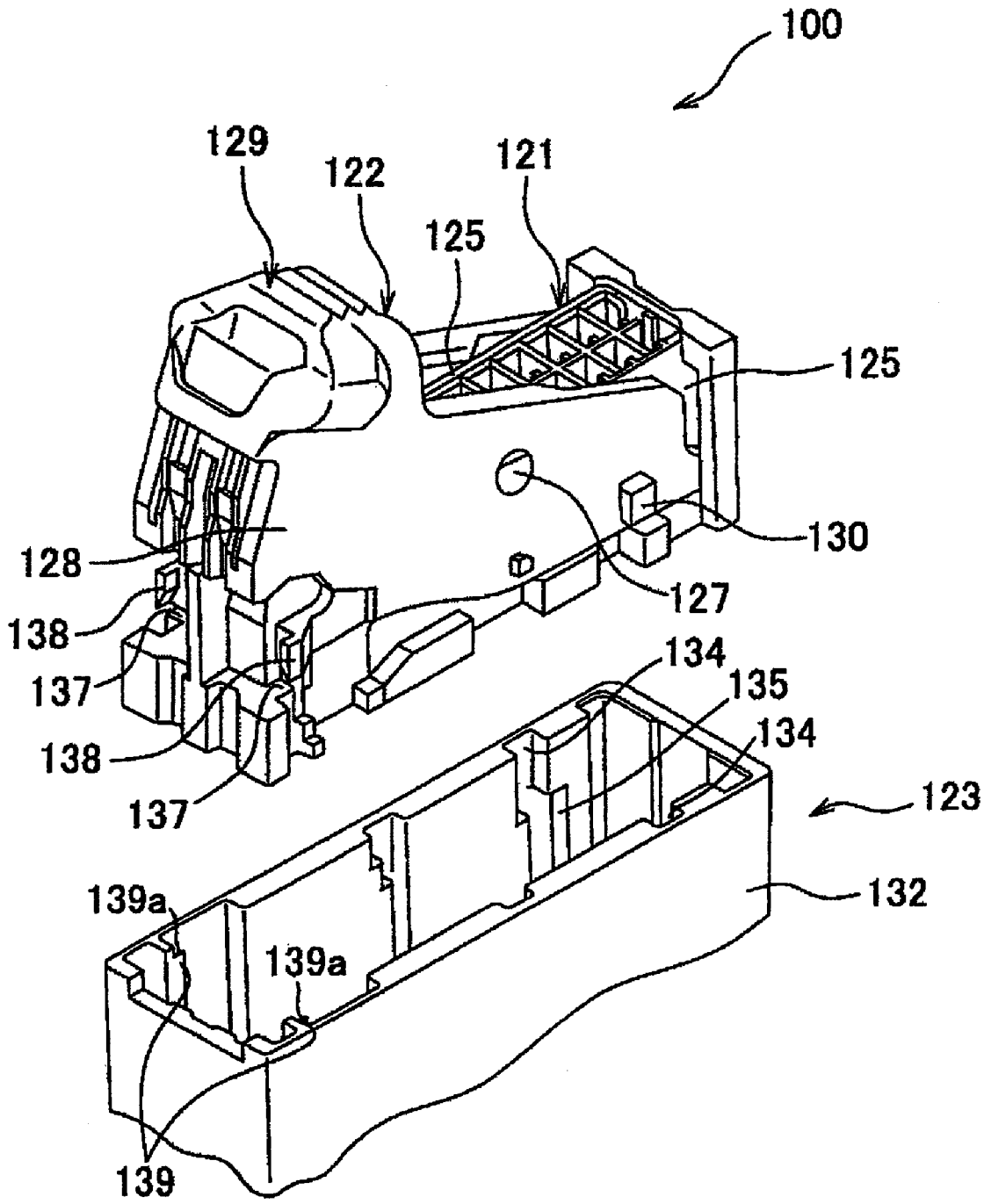
FIG. 18 is a perspective showing a related lever fitting type connector.

In the invention, an angle of the taper portion 35*a* is desirably in a range of 60° to 90−($\tan^{-1}$×friction coefficient μ)°, and is set to 60° in the embodiment. Additionally, the known taper portion (see the taper portion 139*a* shown in FIG. 18) has an angle smaller than 60°. Likewise, since the angle of the taper portion 35*a* is larger than that of the known taper portion, it is possible to reduce a lever operation stroke when the flexible piece 13*b* passes over the taper portion 35*a* more than the related lever fitting type connector. For this reason, even when a force is applied to the operation portion 14 in a different manner, a deviation hardly occurs at timing when the unrotatable state of the lever 1 is released. Accordingly, it is possible to reliably position the fulcrum protrusion 12 to the fulcrum protrusion receiving groove 37 at a time point when the unrotatable state of the lever 1 is released.

Additionally, a locking force (temporary locking force) of the contact convex portion 13*a* applied to the temporary fixing convex portions 22*a* and 22*b* so as to maintain the unrotatable state of the lever 1, that is, the difficulty when the contact convex portion 13*a* is released from the temporary fixing convex portions 22*a* and 22*b* is determined by an amount of a portion where the flexible piece 13*b* overlaps with the taper portion 35*a*, and the locking force becomes zero at a time point when the flexible piece 13*b* completely passes over the taper portion 35*a*. That is, the unrotatable state of the lever 1 is released.

Figure 17:
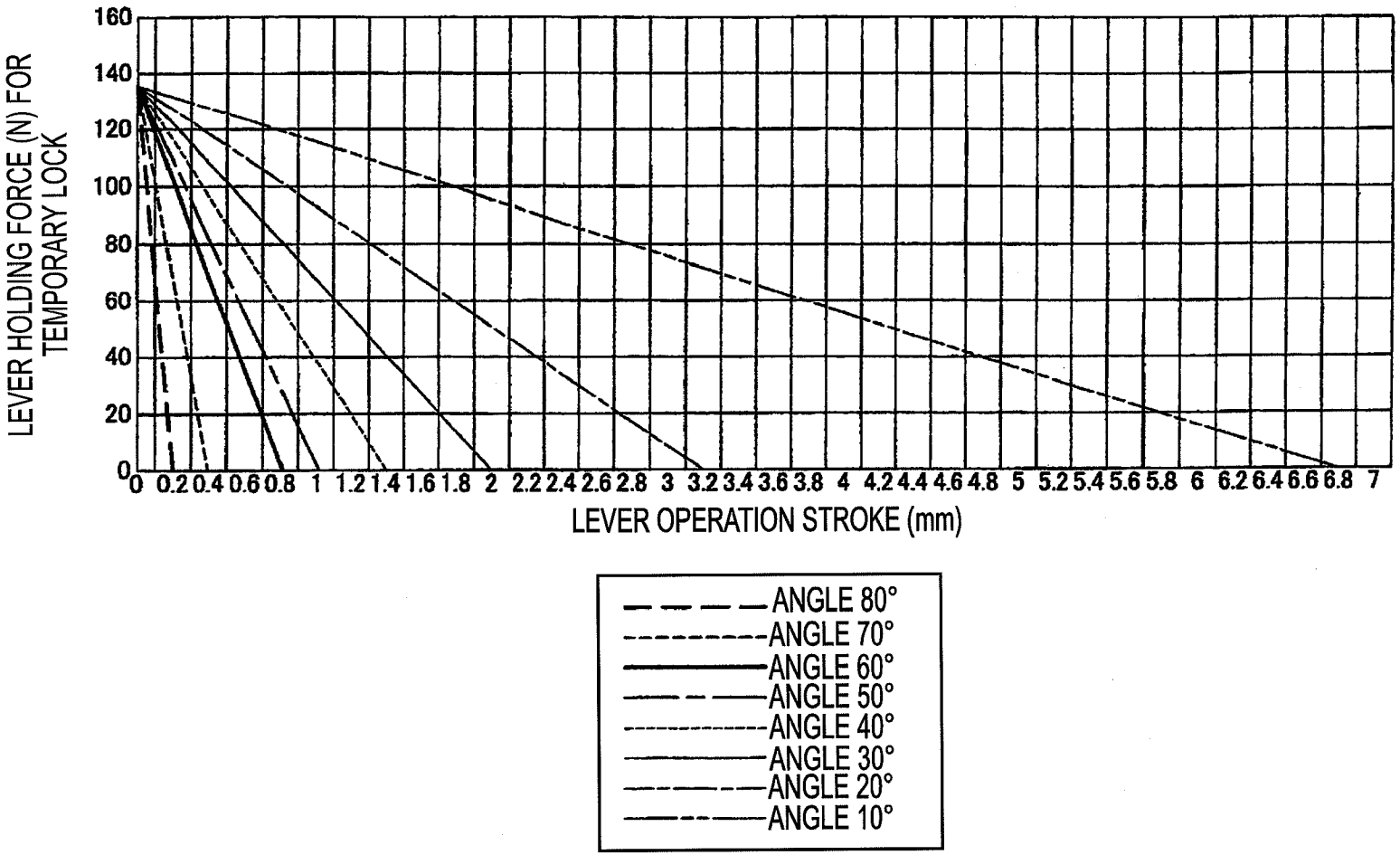
FIG. 17 is a graph showing a relationship between a lever operation stroke and a locking force (a temporary lock holding force) of a contact convex portion applied to a temporary fixing convex portion when an angle of a taper portion is set to be in a range of 10° to 80°.

Additionally, the graph of FIG. 17 shows a relationship between the lever operation stroke and the locking force (temporary lock holding force) of the contact convex portion 13*a* applied to the temporary fixing convex portions 22*a* and 22*b* of each of the lever fitting type connectors (the configuration is the same as that of the lever fitting type connector 10 except for the configuration of the taper portion 35*a*) when the angle of the taper portion 35*a* is set to 10°, 20°, 30°, 40°, 50°, 60°, 70°, and 80°. "The lever operation stroke" in an X axis of the graph shown in FIG. 17 denotes a movement amount of the operation portion 14 of the lever 1 in the fitting direction K. "The lever temporary lock holding force" in a Y axis of the graph shown in FIG. 17 denotes a load necessary for the contact convex portion 13*a* so as to pass over the temporary fixing convex portions 22*a* and 22*b* during the lever operation stoke of each of the lever fitting type connectors.

As understood from the graph shown in FIG. 17, when a load of 70 N is applied at a taper angle 10°, the contact convex portion 13*a* passes over the temporary fixing convex portions 22*a* and 22*b* at a time point earlier by 3.5 mm than the lever operation stroke when the contact convex portion 13*a* normally passes over the temporary fixing convex portions 22*a* and 22*b*. Additionally, when a load of 40 N is applied at a taper angle 10°, the contact convex portion 13*a* passes over the temporary fixing convex portions 22*a* and 22*b* at a time point earlier by 2 mm than the lever operation stroke when the contact convex portion 13*a* normally passes over the temporary fixing convex portions 22*a* and 22*b*. Likewise, as understood from the graph shown in FIG. 17, in case of a product with the taper portion 35*a* having a small taper angle, the unrotatable state of the lever 1 may be released at an early time point of the lever operation stroke.

For this reason, in order to release the unrotatable state of the lever 1 in a state where the terminals 29 and 31 do not contact with each other in a state where the connectors 2 and 3 are temporarily connected to each other and the fulcrum protrusion 12 is reliably positioned to the fulcrum protrusion receiving groove 37, it is necessary to prevent a case in which the unrotatable state of the lever 1 is released at an early time point upon applying a load. Therefore, since the inventors of the invention have compared with an early release amount upon applying a load of 70 N and found out that an early release amount is 0.5 mm or more when the taper angle is not more than 50°, the inventors of the invention set the taper angle of the product according to the invention to be in a range of 60° to 90−($\tan^{-1}$×friction coefficient μ)°. An upper limit of the taper angle is 90° at which the release plate portion 35 cannot physically advance to the inside of the flexible piece 13*b*. Actually, the upper limit is 90−($\tan^{-1}$×friction coefficient μ)° corresponding to an angle in which the friction coefficient μ is converted into an angle.

Figure 6A:
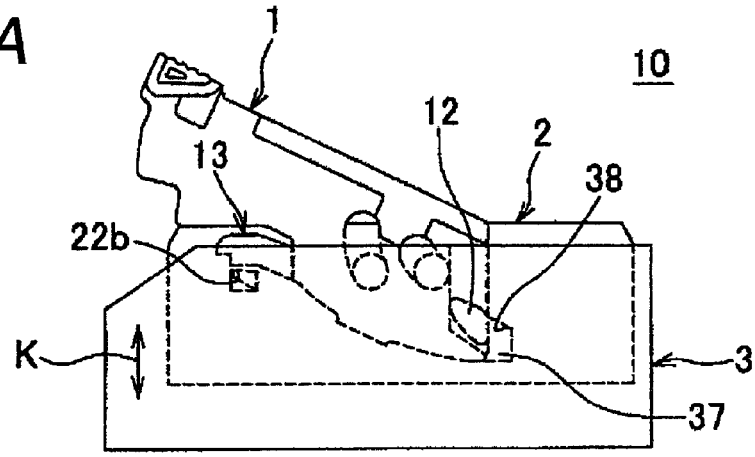
FIG. 6A is a top view showing an initial fitting step of the lever fitting type connector shown in FIG. 1.
Figure 6B:
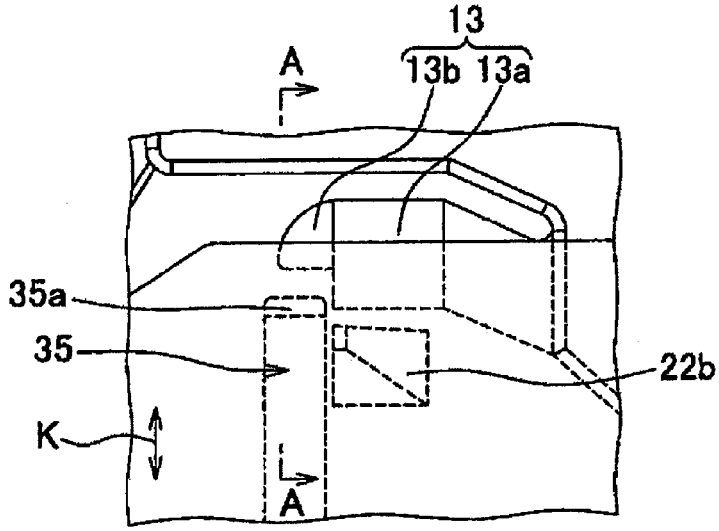
FIG. 6B is an enlarged view showing a temporary retaining portion of the lever fitting type connector shown in FIG. 6A.
Figure 6C:
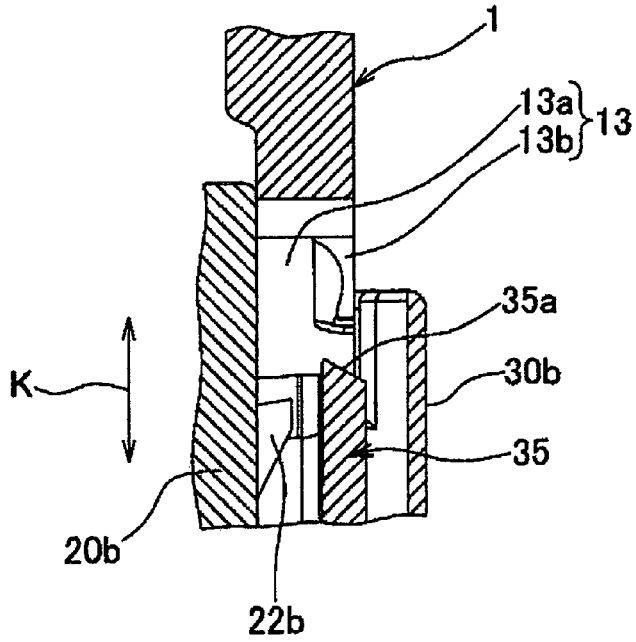
FIG. 6C is a sectional view taken along the line A-A shown in FIG. 6B.

In the lever fitting type connector 10, the lever 1 is mounted to the male connector 2, and the male connector 2 is inserted into the fitting space 39 of the connector housing 30 of the female connector 3 (see FIG. 6A) in a state where the lever 1 is in an unrotatable state (see FIGS. 6A, 6B, and 6C).

Figure 7A:
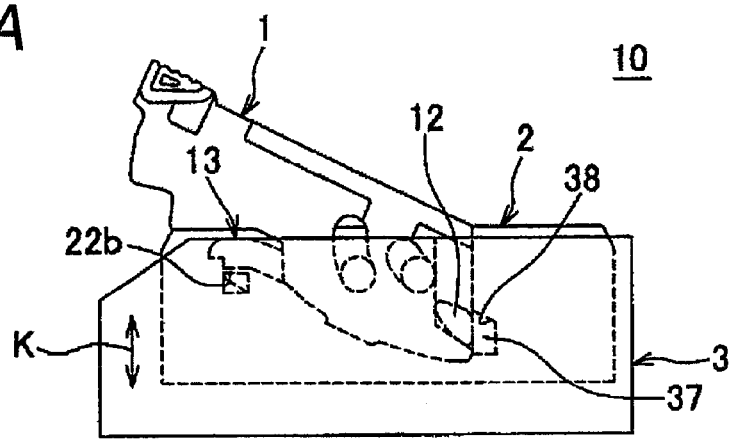
FIG. 7A is a top view showing a state where the male connector of the lever fitting type connector shown in FIG. 6 is further inserted into the female connector.
Figure 7B:
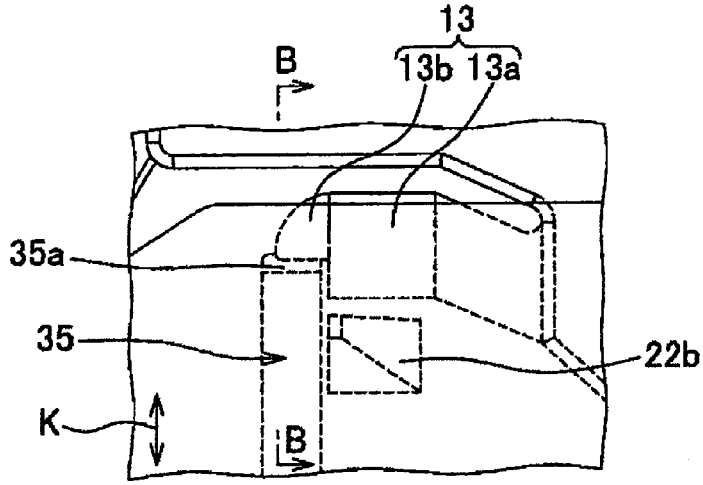
FIG. 7B is an enlarged view showing the temporary retaining portion of the lever fitting type connector shown in FIG. 7A.
Figure 7C:
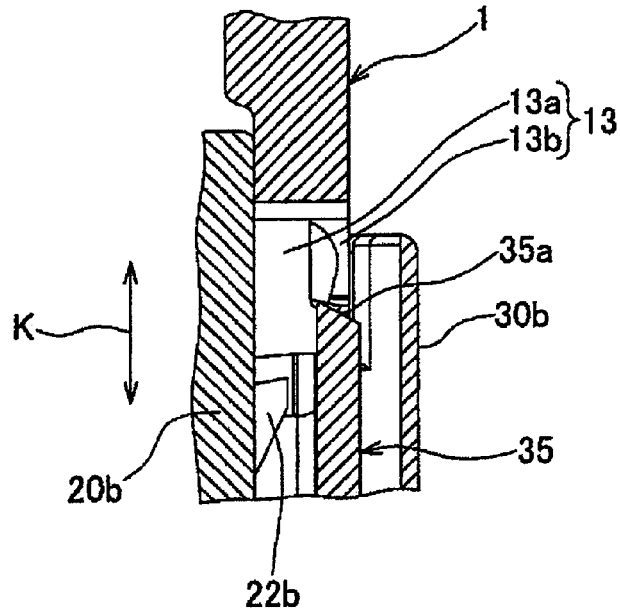
FIG. 7C is a sectional view taken along the line B-B shown in FIG. 7B.
Figure 12A:
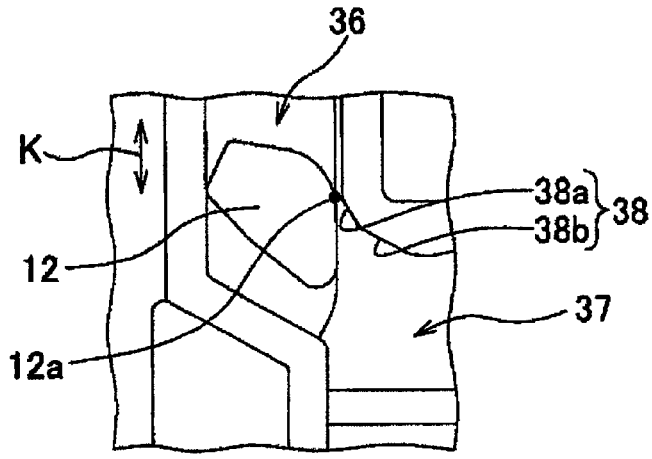
FIG. 12A is an enlarged view showing a fulcrum protrusion of the lever fitting type connector shown in FIG. 7.
Figure 12B:
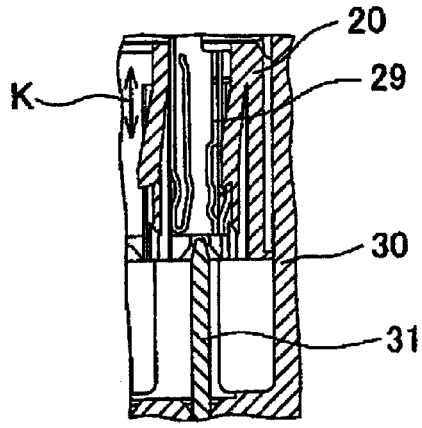
FIG. 12B is a sectional view showing a positional relationship between terminals of the lever fitting type connector shown in FIG. 12A.
Figure 12C:
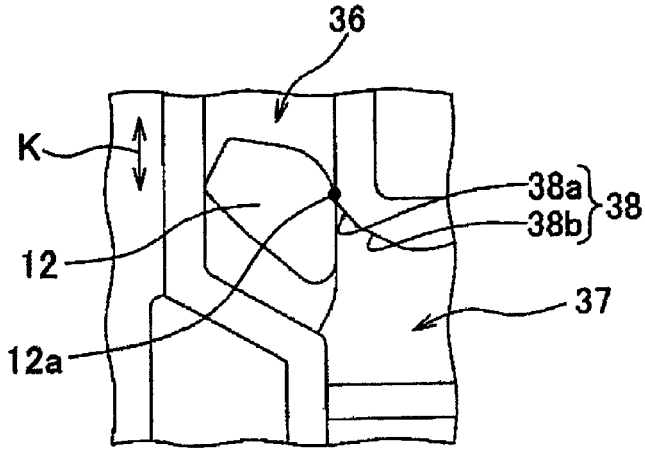
FIG. 12C is an explanatory view showing a position of the fulcrum protrusion upon releasing the unrotatable state of the lever of the lever fitting type connector shown in FIG. 12A.

Then, as shown in FIG. 7A, when the male connector 2 is inserted up to an insertable position of the connector housing 30 by means of a self weight of the male connector 2, as shown in FIGS. 7B and 7C, the upper end portion of the taper portion 35*a* of the release plate portion 35 advances to the inside of the flexible piece 13*b*. As shown in FIG. 12A, in this state, the outer edge portion 12*a*, positioned at a position closest to the one end portion of the lever 1, of the fulcrum protrusion 12 is positioned at a position above the second taper wall 38*a* in the fitting direction K. That is, the fulcrum protrusion 12 is positioned to the inside of the fulcrum protrusion guiding groove 36. Additionally, as shown in FIG. 12B, the terminals 29 and 31 are not electrically connected to each other. When the unrotatable state of the lever 1 is released and the lever 1 is rotated in this state, as shown in FIG. 12C, the fulcrum protrusion 12 is not guided to the fulcrum protrusion receiving groove 37, and an idle rotation of the lever 1 occurs.

Figure 8A:
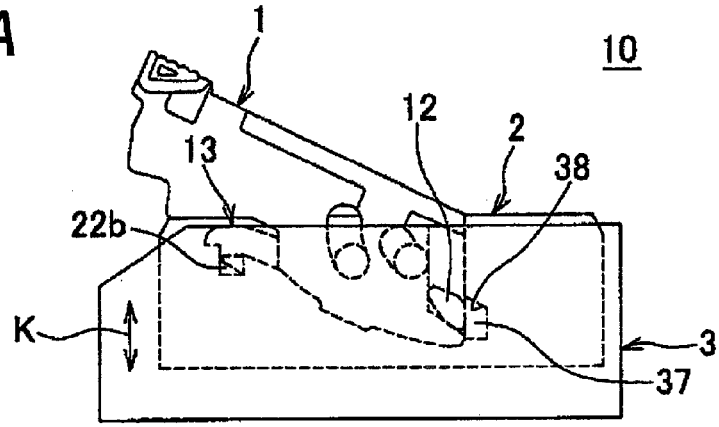
FIG. 8A is a top view showing a state where the male connector of the lever fitting type connector shown in FIG. 7 is pressed to the female connector.
Figure 8B:
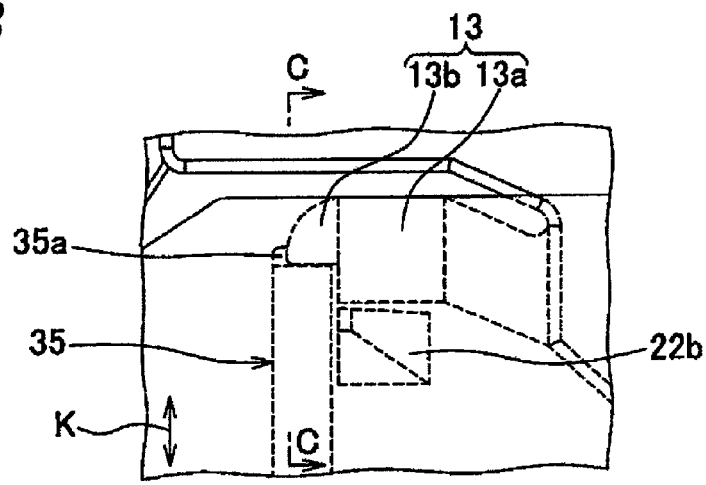
FIG. 8B is an enlarged view showing the temporary retaining portion of the lever fitting type connector shown in FIG. 8A.
Figure 8C:
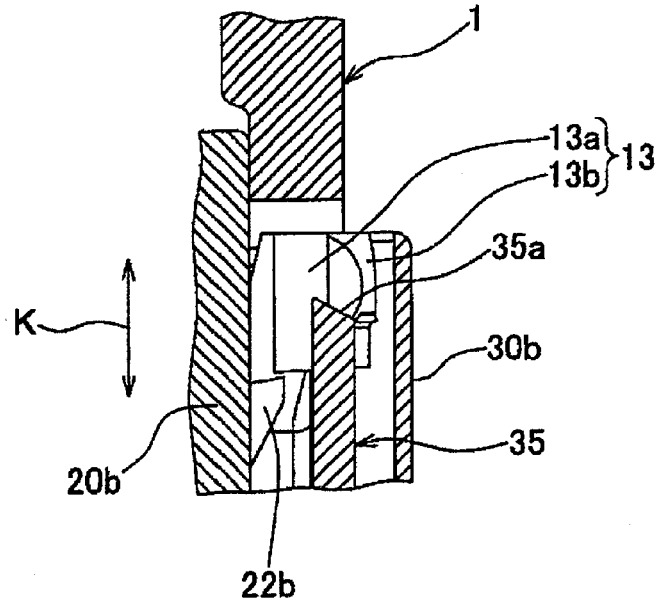
FIG. 8C is a sectional view taken along the line C-C shown in FIG. 8B.

Subsequently, when the lever operation portion 14 of the lever fitting type connector 10 is pressed toward the female connector 3 as shown in FIG. 8A, the taper portion 35*a* advances further to the inside of the flexible piece 13*b* so as to bend the flexible piece 13*b* outward as shown in FIGS. 8B and 8C.

Figure 9A:
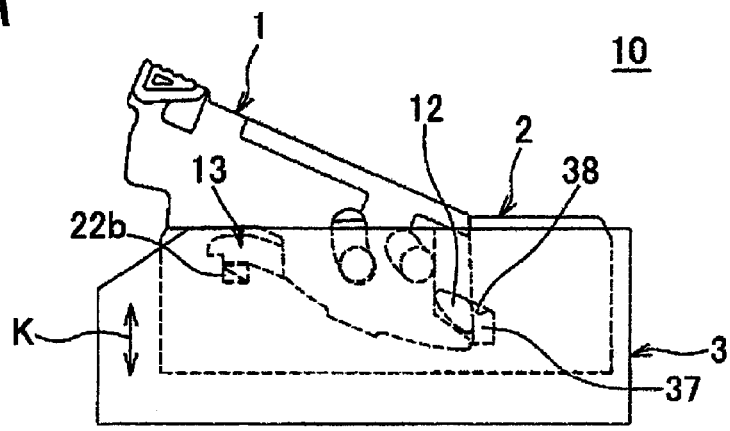
FIG. 9A is a top view showing a state where an unrotatable state of the lever of the lever fitting type connector shown in FIG. 8 is released.
Figure 9B:
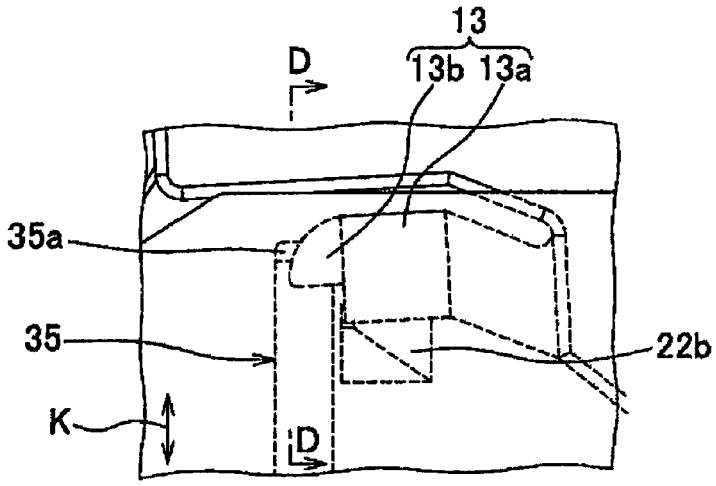
FIG. 9B is an enlarged view showing the temporary retaining portion of the lever fitting type connector shown in FIG. 9A.
Figure 9C:
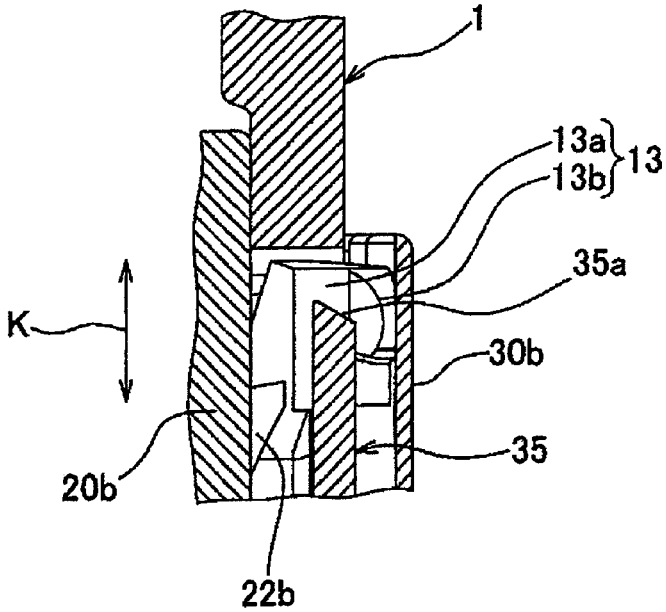
FIG. 9C is a sectional view taken along the line D-D shown in FIG. 9B.
Figure 13A:
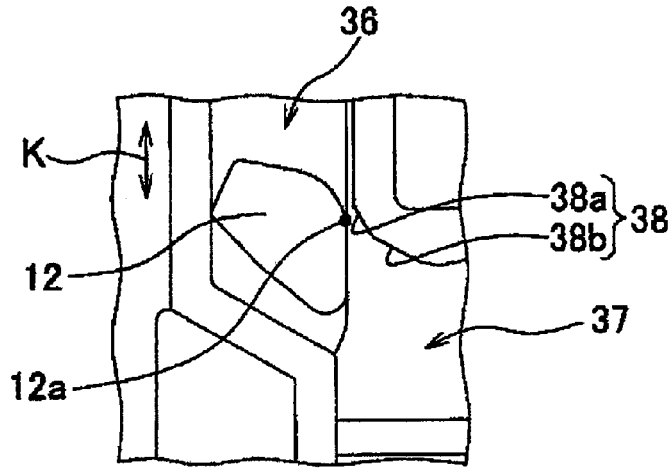
FIG. 13A is an enlarged view showing the fulcrum protrusion of the lever fitting type connector shown in FIG. 9.
Figure 13B:
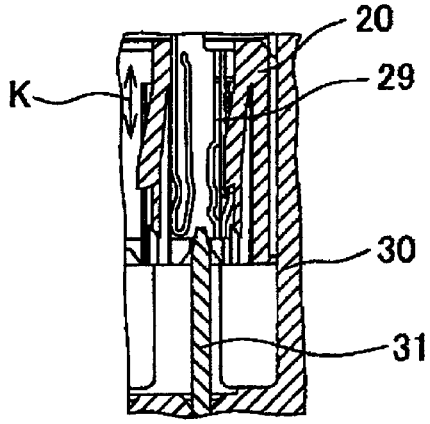
FIG. 13B is a sectional view showing a positional relationship between the terminals of the lever fitting type connector shown in FIG. 13A.
Figure 13C:
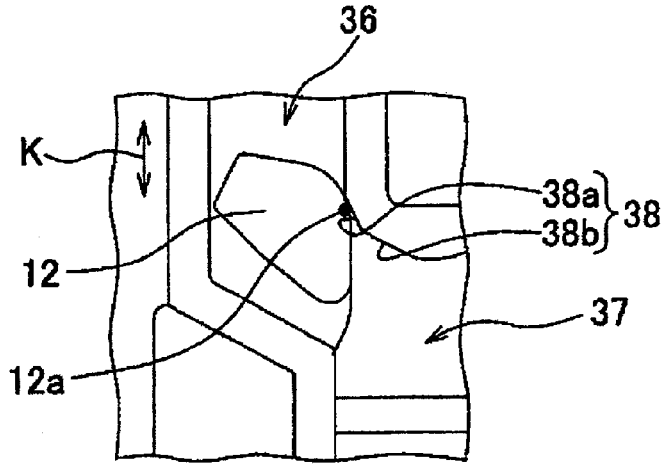
FIG. 13C is an explanatory view showing the position of the fulcrum protrusion upon releasing the unrotatable state of the lever of the lever fitting type connector shown in FIG. 13A.

Additionally, when the operation portion 14 is further pressed, the contact convex portion 13*a* is positioned at a position on the temporary fixing convex portion 22*b* as shown in FIGS. 9A and 9B, and the flexible piece 13*b* completely passes over the taper portion 35*a* as shown in FIG. 9C. Accordingly, the unrotatable state of the lever 1 is released. As shown in FIG. 13A, in this state, the outer edge portion 12*a*, positioned at a position closest to the one end portion of the lever 1, of the fulcrum protrusion 12 is positioned at a position below the second taper wall 38*a* in the fitting direction K. That is, the fulcrum protrusion 12 is positioned to the inside of the fulcrum protrusion receiving groove 37. Additionally, as shown in FIG. 13B, the terminals 29 and 31 are not electrically connected to each other. When the lever 1 is rotated in this state, as shown in FIG. 13C, the fulcrum protrusion 12 is selected by the second taper wall 38*a* to be guided to the fulcrum protrusion receiving groove 37. Then, the outer edge portion 12*a* comes into contact with the second taper wall 38*a* so as to allow the fulcrum protrusion 12 to serve as a fulcrum.

Figure 10A:
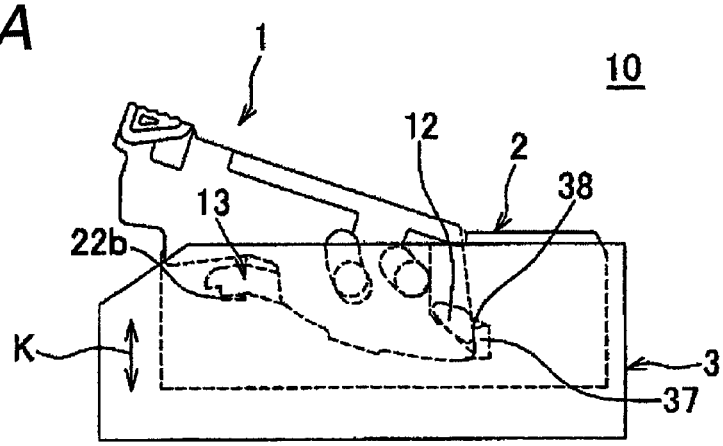
FIG. 10A is a top view showing a state where the connectors of the lever fitting type connector shown in FIG. 9 are temporarily connected to each other.
Figure 10B:
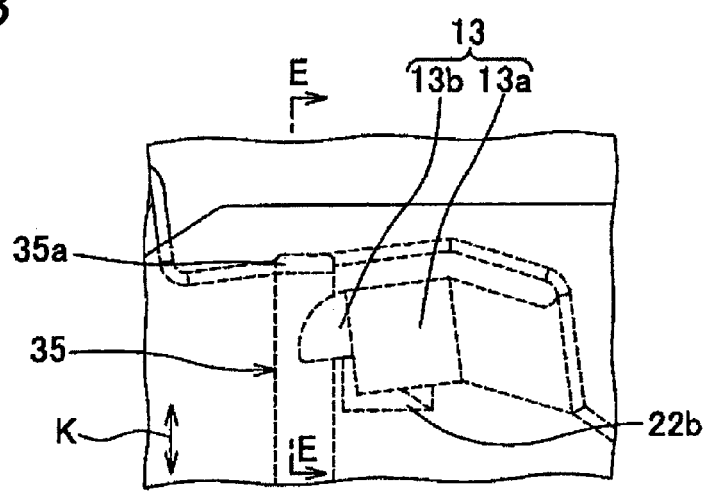
FIG. 10B is an enlarged view showing the temporary retaining portion of the lever fitting type connector shown in FIG. 10A.
Figure 10C:
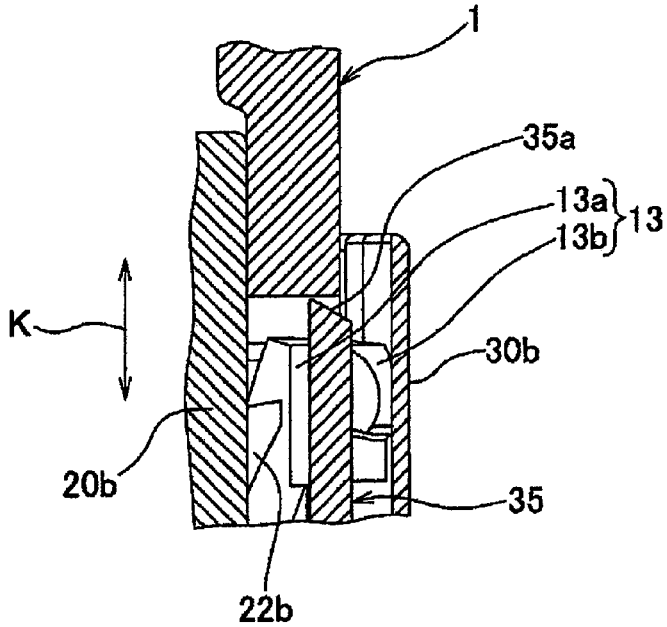
FIG. 10C is a sectional view taken along the line E-E shown in FIG. 10B.
Figure 14A:
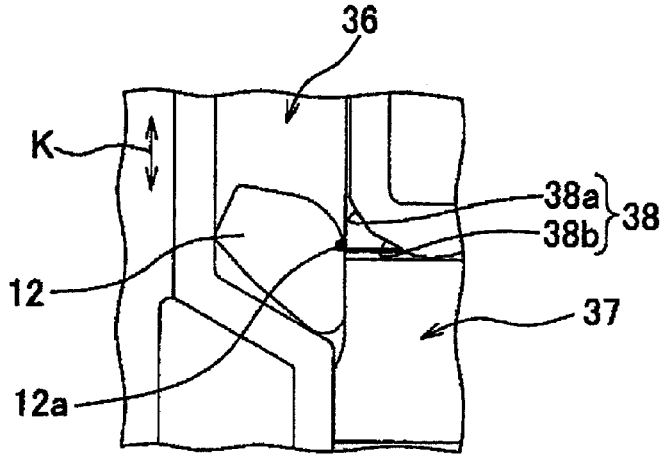
FIG. 14A is an enlarged view showing the fulcrum protrusion of the lever fitting type connector shown in FIG. 10.
Figure 14B:
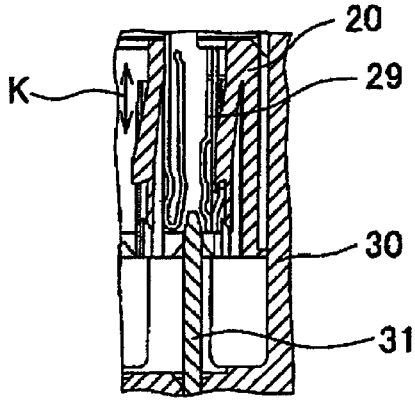
FIG. 14B is a sectional view showing a positional relationship between the terminals of the lever fitting type connector shown in FIG. 14A.
Figure 14C:
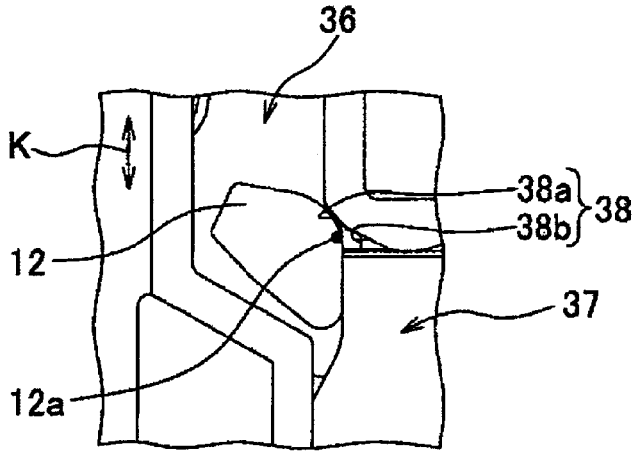
FIG. 14C is an explanatory view showing the position of the fulcrum protrusion upon rotating the lever of the lever fitting type connector shown in FIG. 14A.

Then, as shown in FIGS. 10A and 14A, the outer edge portion 12*a*, positioned at a position closest to the one end portion of the lever 1, of the fulcrum protrusion 12 is positioned at a position below the first taper wall 38*b* in the fitting direction K. That is, the fulcrum protrusion 12 is positioned to the inside of the fulcrum protrusion receiving groove 37. Additionally, this position is represented as a state in which the connectors 2 and 3 are temporarily connected to each other. As shown in FIG. 14B, the terminals 29 and 31 are not electrically connected to each other. When the lever 1 is rotated in this state, as shown in FIG. 14C, the outer edge portion 12*a* of the fulcrum protrusion 12 comes into contact with the first taper wall 38*b* so as to allow the fulcrum protrusion 12 to serve as a fulcrum.

Figure 11A:
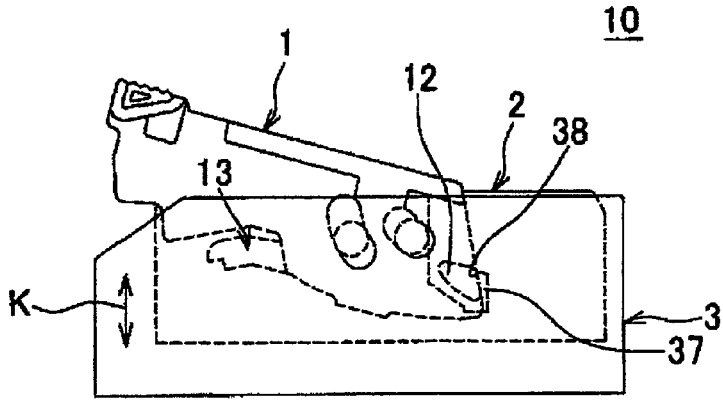
FIG. 11A is a top view showing a state where the lever of the lever fitting type connector shown in FIG. 10 starts to rotate.
Figure 11B:
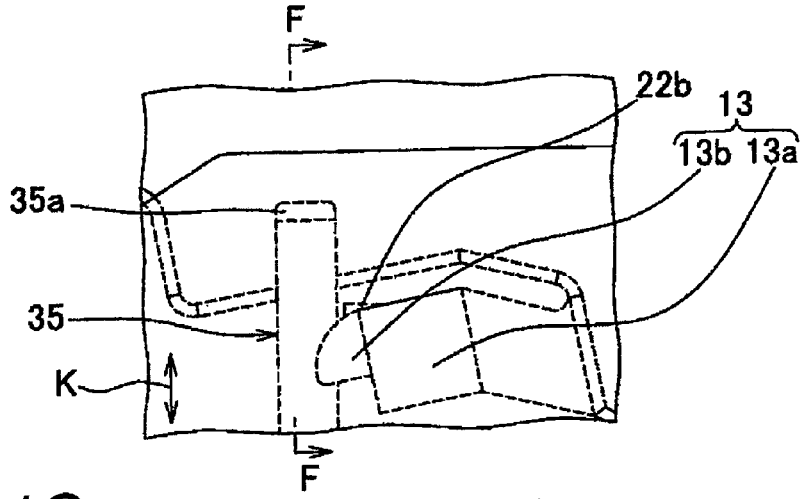
FIG. 11B is an enlarged view showing the temporary retaining portion of the lever fitting type connector shown in FIG. 11A.
Figure 11C:
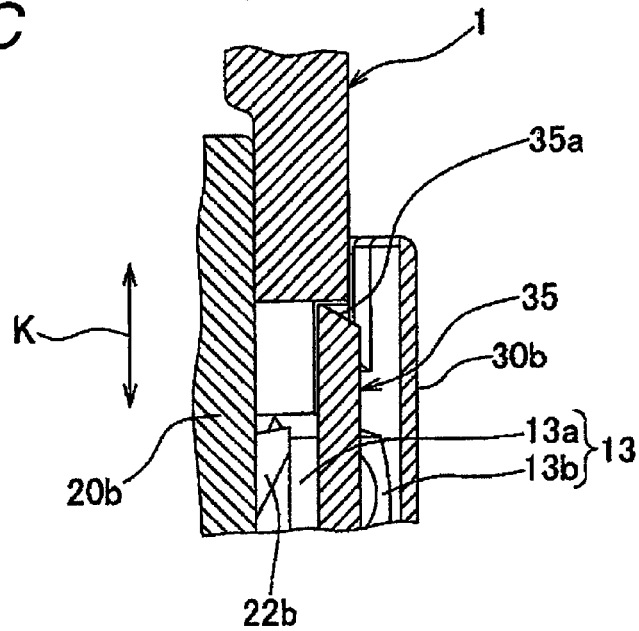
FIG. 11C is a sectional view taken along the line F-F shown in FIG. 11B.
Figure 15A:
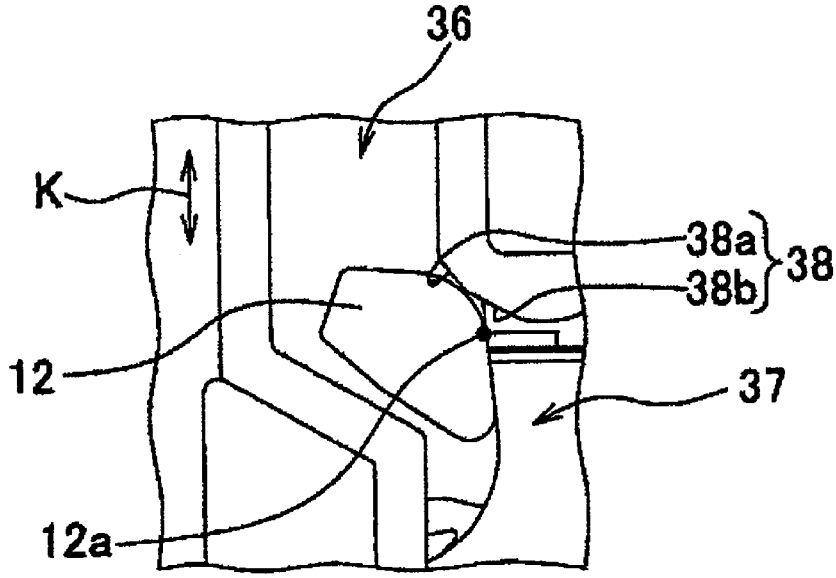
FIG. 15A is an enlarged view showing the fulcrum protrusion of the lever fitting type connector shown in FIG. 11.
Figure 15B:
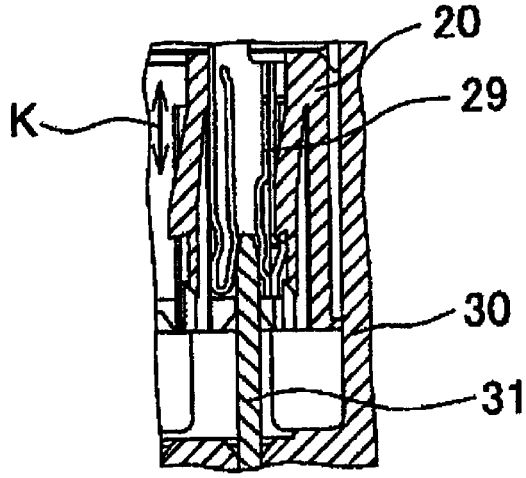
FIG. 15B is a sectional view showing a positional relationship between the terminals of the lever fitting type connector shown in FIG. 15A.

When the lever 1 starts to be rotated in this manner, as shown in FIG. 11A, the boss portion receiving holes 11*a* and 11*b* serve as an action point of the lever 1, and the boss portions 21*a* and 21*b* are pressed to the inside of the fitting space 39 in the fitting direction K. Accordingly, as shown in FIG. 15B, the terminal 31 is fitted to the terminal 29, thereby electrically connecting the terminals 29 and 31 to each other.

Likewise, in the invention, the unrotatable state of the lever 1 is released and the connectors 2 and 3 are temporarily connected to each other just before the terminals 29 and 31 are fitted to each other. That is, the unrotatable state of the lever 1 is released at a late timing, and the unrotatable state thereof is released after the fulcrum protrusion 12 is guided to the inside of the fulcrum protrusion receiving groove 37. Accordingly, at a time point when the unrotatable state of the lever 1 is released, it is possible to reliably position the fulcrum protrusion 12 to the inside of the fulcrum protrusion receiving groove 37.

Additionally, in the invention, "the state where the fulcrum protrusion 12 is positioned at the fulcrum protrusion receiving groove 37" indicates a state where the outer edge portion 12*a* positioned at a position closest to the one end portion of the lever 1 is positioned at a position below the second taper wall 38*a*, that is, at a position on the side of the bottom surface 32 in the fitting direction K. That is, the fulcrum protrusion receiving groove 37 is a region where the fulcrum protrusion 12 is capable of serving as a fulcrum of the lever 1. In other words, the fulcrum protrusion receiving groove 37 is a region where the fulcrum protrusion 12 is capable of allowing the male connector 2 and the female connector 3 to be adjacent to each other.

Figure 16:
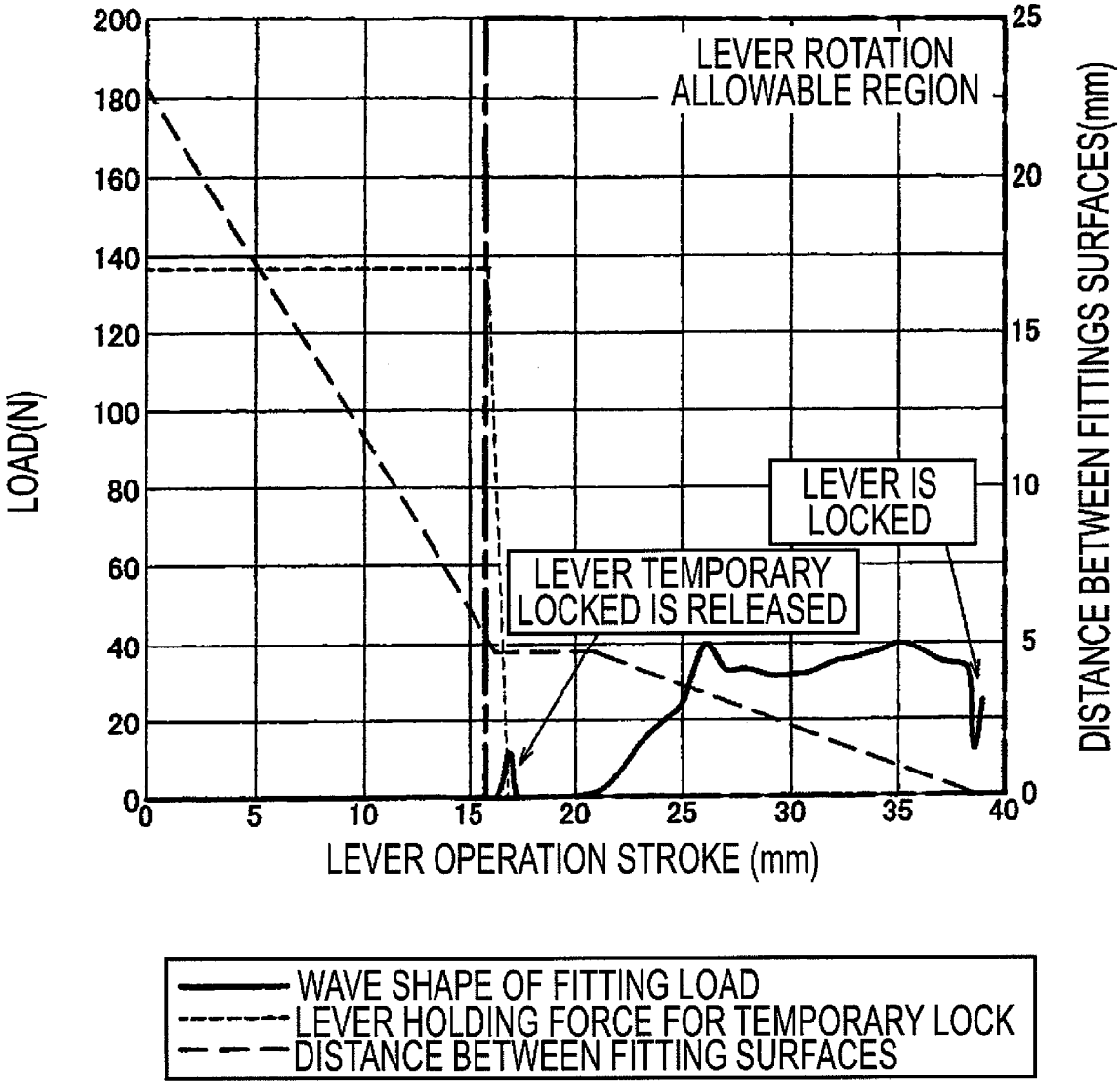
FIG. 16 is a graph showing a relationship of a fitting load, a lever temporary lock holding force, and a lever operation stroke of the lever fitting type connector shown in FIG. 1.

Further, the graph of FIG. 16 shows a relationship of the fitting load, the lever temporary lock holding force, and the lever operation stroke of the lever fitting type connector 10 according to the invention.

In the graph of FIG. 16, "a wave shape of fitting load" indicates a force applied to an operator's hand upon pressing the operation portion 14. Additionally, "a distance between fitting surfaces" indicates a distance indicated by the arrow L of FIG. 1, and a distance from the lower end portion of the male connector 2 to the inner surface 32*a* of the bottom surface 32 of the female connector 3. "A lever rotation allowable region" indicates a lever operation stroke range in a state where the fulcrum protrusion 12 is positioned at a region (i.e., the fulcrum protrusion receiving groove 37) where the fulcrum protrusion 12 is capable of serving as a fulcrum of the lever 1.

As understood from the graph of FIG. 16, in the lever fitting type connector 10 according to the invention, a lever temporary locking releasing operation (an operation for releasing the unrotatable state of the lever 1) is carried out in the lever rotation allowable region. Additionally, the lever temporary lock holding force indicated by the dotted line is depicted by the substantially perpendicular inclination, and the lever operation stroke is short when the flexible piece 13*b* passes over the taper portion 35*a*. This means that the position (which indicates the lever operation stroke) for releasing the unrotatable state of the lever 1 is substantially uniform even when a force is applied to the operation portion 14 in a different manner. For this reason, it is possible to reliably position the fulcrum protrusion 12 to the inside of the fulcrum protrusion receiving groove 37 at a time point when the unrotatable state of the lever 1 is released. Accordingly, it is possible to provide the lever fitting type connector 10 capable of reliably fitting the connectors 2 and 3 to each other by preventing an idle rotation of the lever 1.

Further, the above-described embodiment is exemplary of the invention, and the invention is not limited thereto. That is, various modifications may be made without departing from the gist of the invention.

The present application is based on Japan Patent Application No. 2008-028603 filed on Feb. 8, 2009, the contents of which are incorporated herein for reference.

What is claimed is:

1. A lever fitting type connector, comprising:

a male connector;

a lever which is rotatably attached to the male connector; and a female connector which has a fitting space into which the male connector is inserted, wherein the lever has a fulcrum protrusion provided on one end portion of the lever;

wherein an inner wall forming the fitting space of the female connector has a guiding groove portion and a receiving groove portion for receiving the fulcrum protrusion;

wherein the guiding groove portion extends in a fitting direction of the male connector with respect to the female connector from an upper end portion of the inner wall toward the inside of the fitting space;

wherein the receiving groove portion is communicated with the guiding groove portion and extends in a direction intersecting the fitting direction from one end of the guiding groove portion which is away from the upper portion of the inner wall;

wherein the lever has a temporary retaining portion for preventing the lever from rotating to the female connector at an initial fitting process;

wherein the inner wall has a release portion for releasing engagement of the lever by the temporary retaining portion such that the lever is converted from an unrotatable state to a rotatable state;

wherein when the lever is pressed toward the female connector so as to rotate the lever in a state where the fulcrum protrusion of the lever is positioned to the inside of the receiving groove portion, the fulcrum protrusion serves as a fulcrum, a center portion of the lever serves as an action point, and the male connector is pressed to the inside of the fitting space in the fitting direction;

wherein the fulcrum protrusion is positioned to the inside of the receiving groove portion at a time when the unrotatable state of the lever is released;

wherein an edge wall forming the receiving groove portion has a first taper wall and a second taper wall for guiding the fulcrum protrusion to the first taper wall;

wherein the first taper wall is inclined so as to decrease a width of the receiving groove portion in a direction away from the guiding groove portion; and wherein the second taper wall is inclined so as to increase a width of the receiving groove portion in a direction from the first taper wall to the guiding groove portion.

2. The lever fitting type connector according to claim 1, wherein the temporary retaining portion is abutted against a temporary fixing convex portion of the male connector for preventing the lever from rotating to the female connector;

wherein the release portion releases the temporary retaining portion by advancing to the inside of the temporary retaining portion to bend the temporary retaining portion outward so that the temporary retaining portion passes over to the temporary fixing convex portion as the male connector moves close to the female connector, wherein a taper portion, whose thickness is gradually increased toward the inside of the fitting space in the fitting direction, is provided on an upper end portion of the release portion; and wherein an angle of the taper portion is in a range of 60° to $90-(\tan^{-1}\times\text{friction coefficient } \mu)°$.

* * * * *